US010226951B1

(12) United States Patent
Campbell

(10) Patent No.: US 10,226,951 B1
(45) Date of Patent: Mar. 12, 2019

(54) SYSTEM AND METHOD FOR PIVOTING A PRINTHEAD IN A DIRECT-TO-OBJECT PRINTER DURING PRINTING OF AN OBJECT

(71) Applicant: Xerox Corporation, Norwalk, CT (US)

(72) Inventor: Richard A. Campbell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/812,097

(22) Filed: Nov. 14, 2017

(51) Int. Cl.
*B41J 25/00* (2006.01)
*B41J 29/02* (2006.01)

(52) U.S. Cl.
CPC ..... *B41J 25/001* (2013.01); *B41J 29/02* (2013.01)

(58) Field of Classification Search
CPC ..... B41J 29/02; B41J 25/001
See application file for complete search history.

(56) References Cited

U.S. PATENT DOCUMENTS 7,518,702 B2 * 4/2009 Sakurada ..... G02F 1/1341 349/153
2008/0072775 A1 3/2008 Landesman et al.
2009/0058941 A1 3/2009 Kurita et al.
2011/0199409 A1 8/2011 Lee et al.
2016/0325498 A1 11/2016 Gelbart
2017/0066189 A1 3/2017 Ur

* cited by examiner

*Primary Examiner* — Lamson Nguyen
(74) *Attorney, Agent, or Firm* — Maginot Moore & Beck LLP

(57) ABSTRACT

A direct-to-object printer includes a printhead pivoting subsystem. The printhead pivoting subsystem includes an actuator that rotates a frame in which a plurality of printheads is mounted. This rotation pivots the printheads about a pivot position to enable the printheads to change orientation with reference to a surface of an object being printed to accommodate contours of the object.

19 Claims, 8 Drawing Sheets

SYSTEM AND METHOD FOR PIVOTING A PRINTHEAD IN A DIRECT-TO-OBJECT PRINTER DURING PRINTING OF AN OBJECT

TECHNICAL FIELD

This disclosure relates generally to a system for printing on three-dimensional (3D) objects, and more particularly, to systems that print on ovoid or irregularly-shaped objects.

BACKGROUND

Commercial article printing typically occurs during the production of the article. For example, ball skins are printed with patterns or logos prior to the ball being completed and inflated. Consequently, a non-production establishment, such as a distribution site or retail store, for example, in a region in which potential product customers support multiple professional or collegiate teams, needs to keep an inventory of products bearing the logos of various teams popular in the area. Ordering the correct number of products for each different logo to maintain the inventory can be problematic.

One way to address these issues in non-production outlets is to keep unprinted versions of the products, and print the patterns or logos on them at the distribution site or retail store. Printers known as direct-to-object (DTO) printers have been developed for printing individual objects. These DTO printers have a plurality of printheads that are typically arranged in a vertical configuration with one printhead over another printhead. These printheads are fixed in orientation. When the objects to be printed are ovoid, such as balls, water bottles, and the like, a complete image cannot be printed on the surface because the portion of the surface of object falls away from the planar face of the printheads. Enabling DTO printers to be able to print images on all or a portion of the ovoid object would be beneficial.

SUMMARY

A new three-dimensional (3D) object printing system provides flexible orientation of the printheads in the system to enable most or all of a surface of an ovoid or irregularly-shaped object to be printed. The printing system includes a frame, at least one printhead, the at least one printhead being mounted to the frame and being configured to eject marking material, a first actuator operatively connected to the frame, the first actuator being configured to rotate the frame about a pivot, a holder configured to hold an object opposite the frame and the at least one printhead, and a controller operatively connected to the first actuator and the at least one printhead. The controller is configured to operate the first actuator to pivot the frame and the at least one printhead about the pivot and to operate the at least one printhead to eject marking material onto the object held by the holder.

A method of operating a 3D object printing system enables most or all of a surface of an ovoid or irregularly-shaped object to be printed in DTO printers. The method includes operating with a controller a first actuator operatively connected to a frame in which at least one printhead is mounted to pivot the frame and the at least one printhead about a pivot, and operating the at least one printhead to eject marking material onto an object held by a holder at a position opposite the frame and the at least one printhead.

BRIEF DESCRIPTION OF THE DRAWINGS

The foregoing aspects and other features of a 3D object printing system and method of operating a 3D object printing system that enables most or all of the surface of an ovoid or irregularly-shaped object to be printed are explained in the following description, taken in connection with the accompanying drawings.

DETAILED DESCRIPTION

Figure 1:
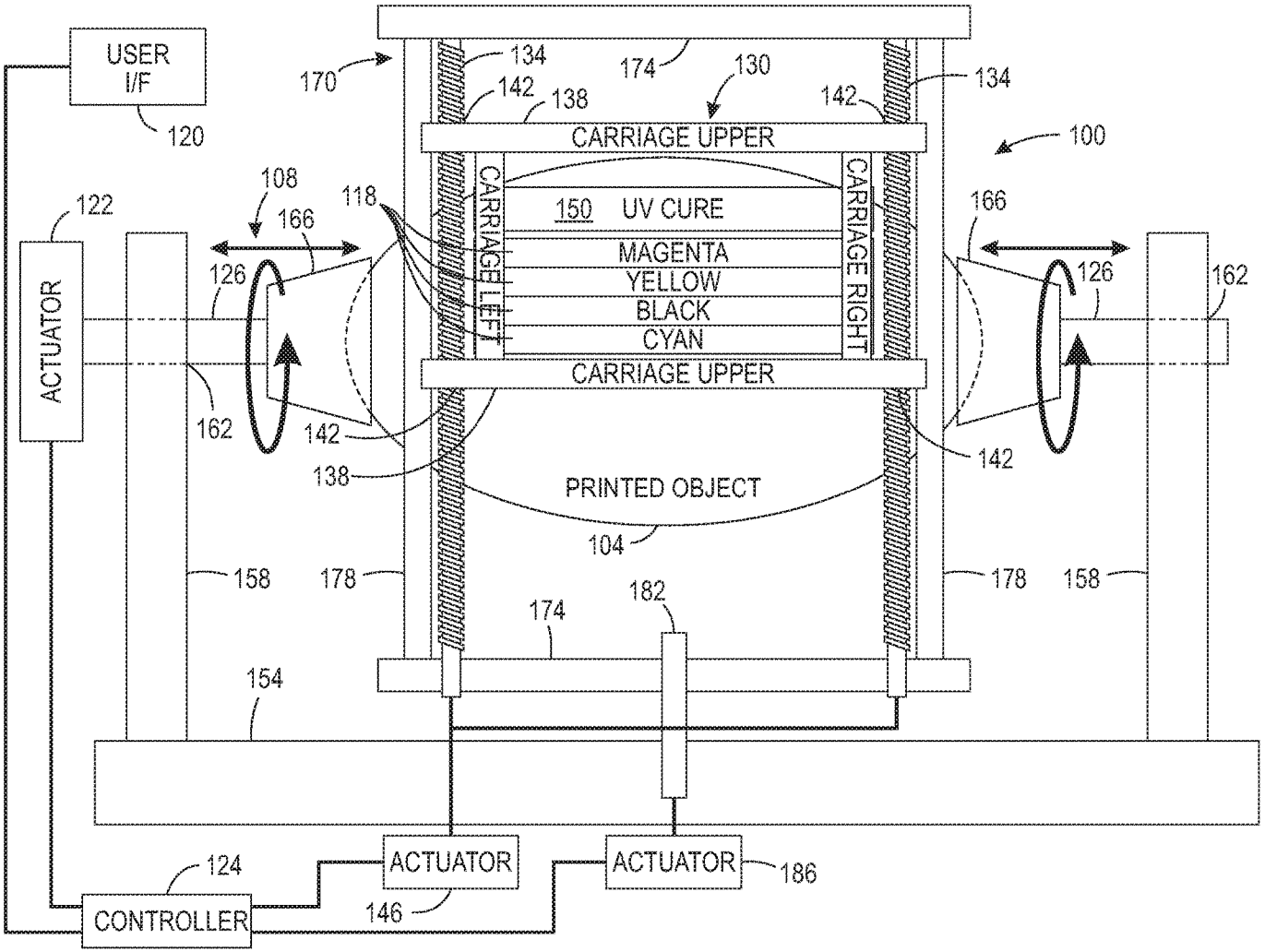
FIG. 1 is a schematic diagram through the rear of a DTO printing system having a printhead pivoting subsystem that enables most or all of the surface of ovoid or irregularly-shaped objects to be printed.

For a general understanding of the present embodiments, reference is made to the drawings. In the drawings, like reference numerals have been used throughout to designate like elements.

FIG. 1 depicts a view of a direct-to-object (DTO) printing system 100 through the rear of the system towards the object being printed. The system 100 is configured with an array of printheads 118 to print the surface of an object 104 that is secured within an object rotating subsystem 108. As used in this document, the word "printhead" means a component having a plurality of ejectors configured to eject marking material. The marking material ejected by an ejector is dependent upon the marking material source to which the ejector is fluidically connected. As used in this document, the word "subsystem" refers to two or more components that are operated to perform a particular function within a larger system. The printheads 118 have longitudinal axes that are parallel to one another and parallel to a longitudinal axis of the object 104. The object rotating subsystem 108 includes a U-shaped frame having a base member 154 to which two vertical members 158 are mounted to form the legs of the U-shaped frame. Each vertical member 158 includes an opening 162, each of which supports a shaft 126. The openings 162 can include a bearing or other component that facilitates the rotation of the shafts 126 within the openings. At the end of each shaft 126 is a gripper 166 that is configured to hold one end or side of an object 104 for printing. The grippers 166 are detachable from the shafts 126 so grippers having different configurations for holding differently shaped objects can be removed and attached to the shafts. At least one shaft 126 is operatively connected to one or more actuators 122 that are configured to rotate the at least one shaft 126 bidirectionally and to translate the shaft 126 bidirectionally as indicated by the arrows in the figure. When the grippers 166 hold a portion of the object 104, the driven shaft 126 also rotates and translates the other shaft 126 along an axis aligned with the two shafts. The controller 124 is operatively connected to actuator 122 and is configured to operate the actuator 122 to move the object rotating subsystem 108 after the object 104 is mounted into the subsystem 108. The operation of the actuator 122 by the controller 124 positions the object laterally and rotationally with reference to the printheads 118.

The printheads 118 are mounted within a carriage frame 130. The cross-frame members are perpendicular to parallel side members 132 to form a rectangular frame, although other frame configurations are possible. The cross-frame members 138 are configured with threaded openings 142 and each pair of openings receives a lead screw 134. The lead screws 134 are operatively connected to one or more actuators 146 that are configured to rotate bidirectionally to raise and lower the frame 130 on the lead screws 134. Alternatively, the frame 130 could be configured with an endless belt and a pair of pulleys on each side of the frame with the pulleys being driven by an actuator to rotate the belt to raise and lower the frame 130. This vertical adjustment of the frame 130 positions the printheads 118 and the ultraviolet (UV) light curing device 150 at various positions opposite the surface of object 104 for printing and the curing of UV material. The carriage frame 130 is mounted within a pivoting frame 170. The frame 170 includes cross-members 174 and vertical members 178. The lower cross-member 174 is mounted to a rotating shaft 182 that is operatively connected to actuator 186 for bidirectional rotation. Controller 124 is also operatively connected to actuator 186 and is configured to operate the actuator 186 to pivot the frame 170 and the frame 130 about the shaft 182 to orient the printheads 118 at angles with reference to the surface of the object 104. Controller 124 is also configured to operate the printheads 118 in the array to eject marking material onto the surface of the object 104. If one or more of the printheads 118 in the array 112 ejects ultraviolet (UV) marking material, then the UV curing device 150 is operated by controller 124 to cure the UV material. As used in this document, "UV light" refers to light having a wavelength that is shorter than visible light, but longer than X-rays. The wavelength of such light is about 10 nm to about 400 nm. An user interface 122 is operatively connected to the controller 124 for purposes described more fully below.

Figure 2:
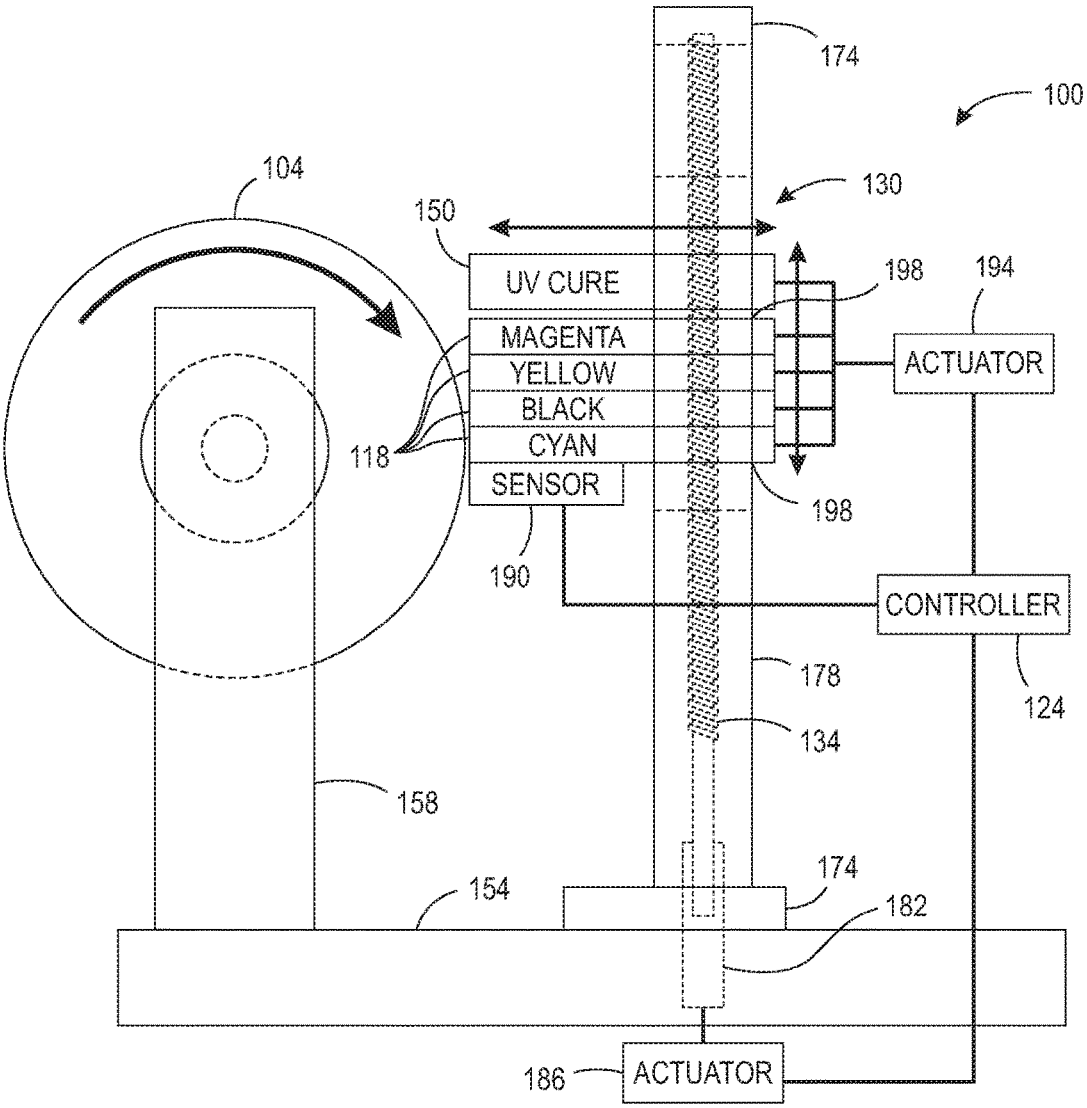
FIG. 2 is a schematic diagram of a side view of the DTO printing system shown in FIG. 1.

FIG. 2 is a side view of the system 100 shown in FIG. 1. This view shows a distance measuring sensor 190 mounted at a position below the printheads 118 and the sensor is operatively connected to the controller 124. This distance sensor is configured to generate data indicative of a distance between the sensor 190 and the portion of the object 104 opposite the sensor. Because the reference point for the distance measurement made by the sensor corresponds to the aligned faces of the printheads 118, the data indicative of the distance between the sensor and the object is useful for determining the distances between the printhead faces and the object. As the frame 130 is moved vertically opposite the object 104, the controller 124 receives the data indicative of the distance between the sensor and the surface of the object 104 and the controller is configured to identify a distance between each faceplate of the printheads 118 and the portion of the object 104 opposite each faceplate. These distances are used by the controller 124 to operate the printheads 118 and form an image on the surface of the object with the marking material ejected by the printheads.

With continued reference to FIG. 2, the printheads 118 and the UV curing device 150 are mounted within slides or channels 198 in the side members of the frame 130. One or more actuators 194 are operatively connected to the printheads 118 and the UV curing device 150 to move the printheads and UV curing device bidirectionally in the slides or channels toward and away from the object 104. Additionally, the one or more actuators 194 are configured to move the printheads 118 and the UV curing device 150 independently of one another to adjust the distance between each printhead 118 or UV curing device 150 and the object surface with reference to the curvature or features of the object 104.

Figure 3:
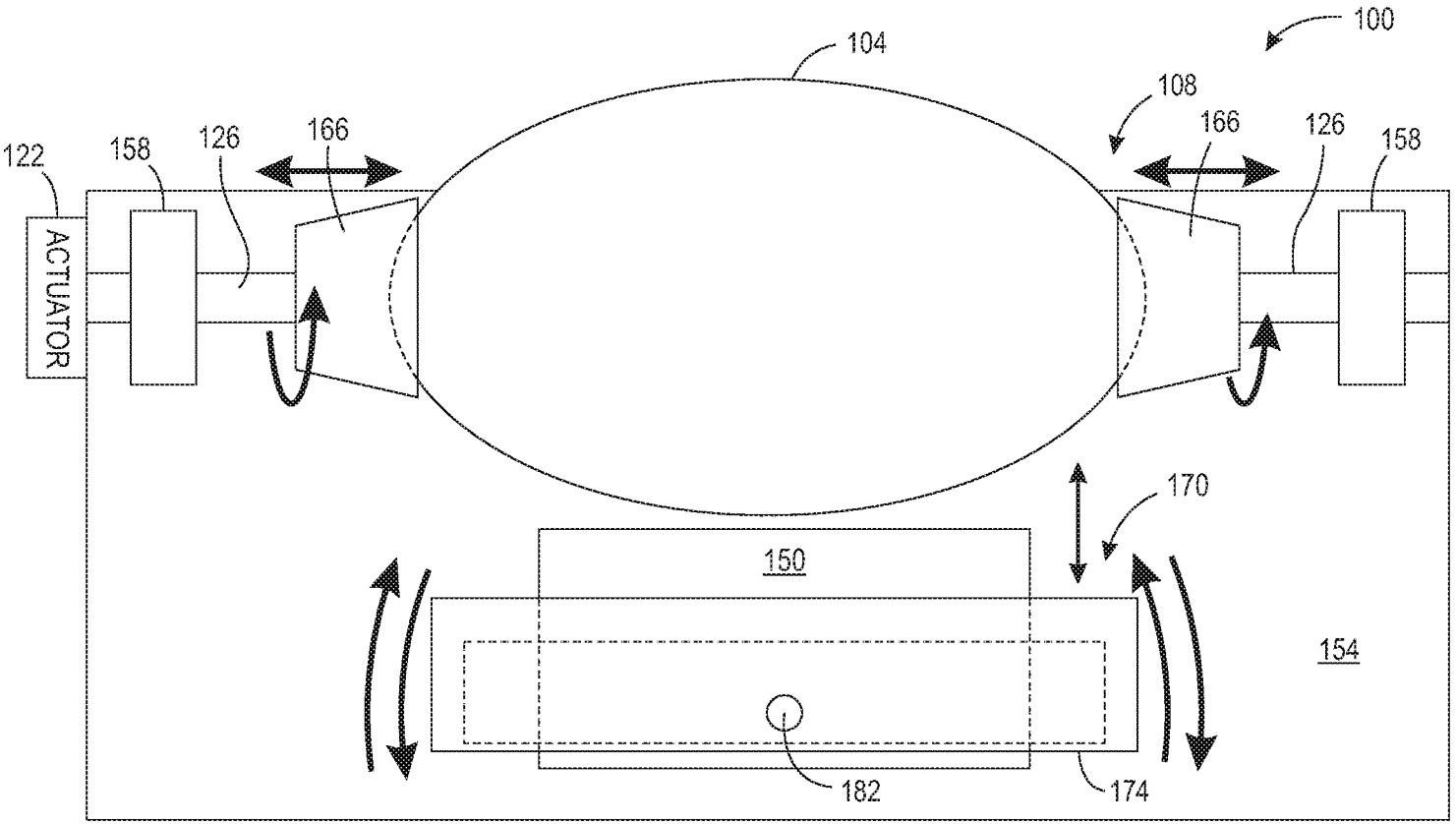
FIG. 3 is a top down view of the system shown in FIGS. 1 and 2.

FIG. 3 provides a view of the printing system 100 from above the system looking down onto the object 104. The arrows indicate the various degrees of motion made possible by the printing system 100. Controller 124 can move the object 104 bidirectionally laterally by operating the actuator 122 and can rotate the object bidirectionally as well. By operating the actuator 186, the controller 124 can pivot the frame 170 bidirectionally about the pivot shaft 182 (FIG. 1). This movement is indicated by the curved arrows in the figure. The controller 124 also operates the actuator 194 (FIG. 2) to move the printheads 118 and the UV curing device 150 toward and away the surface of the object 104. Additionally, the controller 124 operates the actuator 146 (FIG. 1) to move the frame 130 vertically within the frame 170 to adjust the vertical position of the printheads 118 and the UV curing device with reference to the surface of the object 104.

Figure 4A:
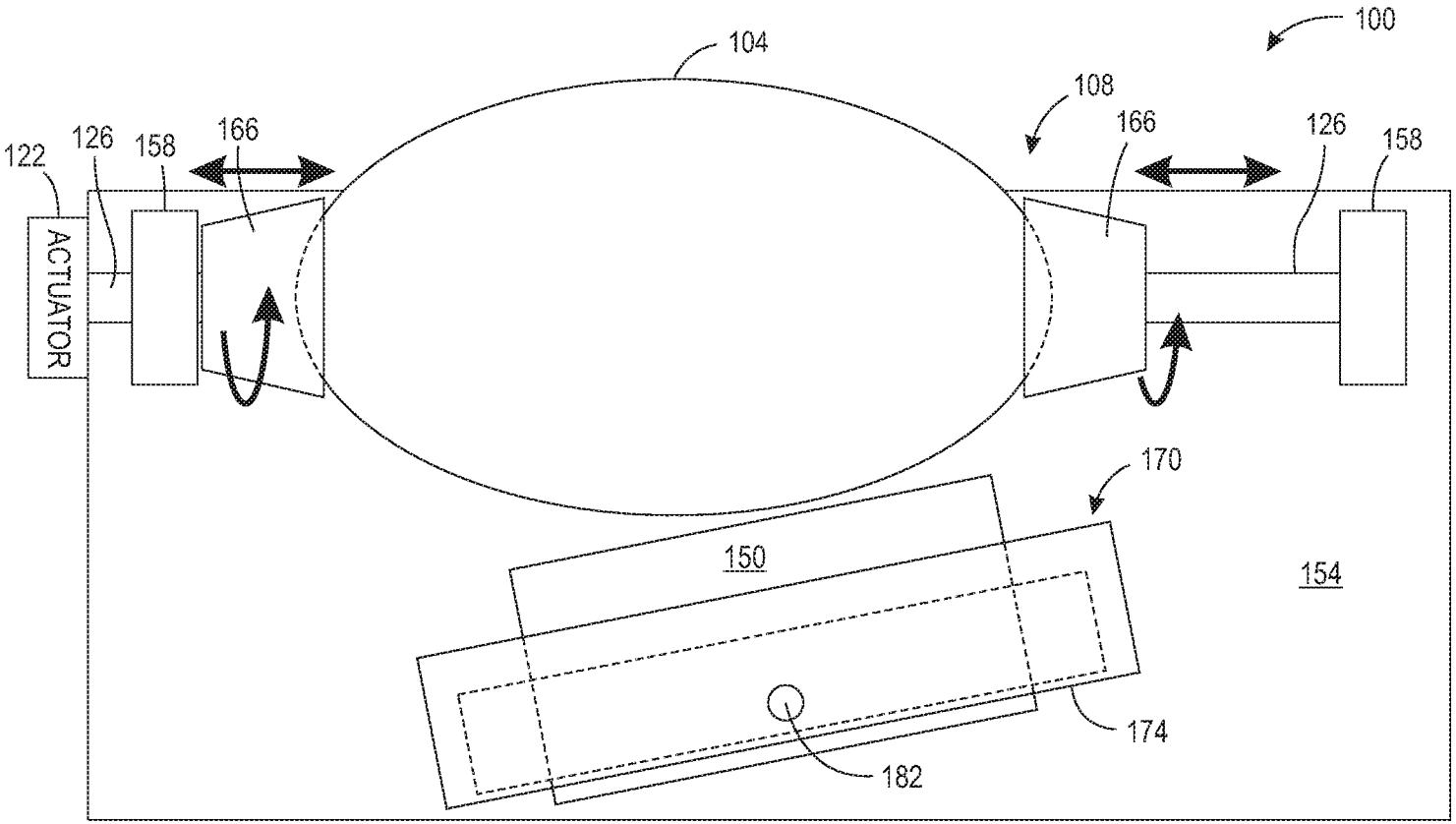
FIG. 4A to 4C depicts a series of printhead positions used to print the surface of a football.
Figure 4B:
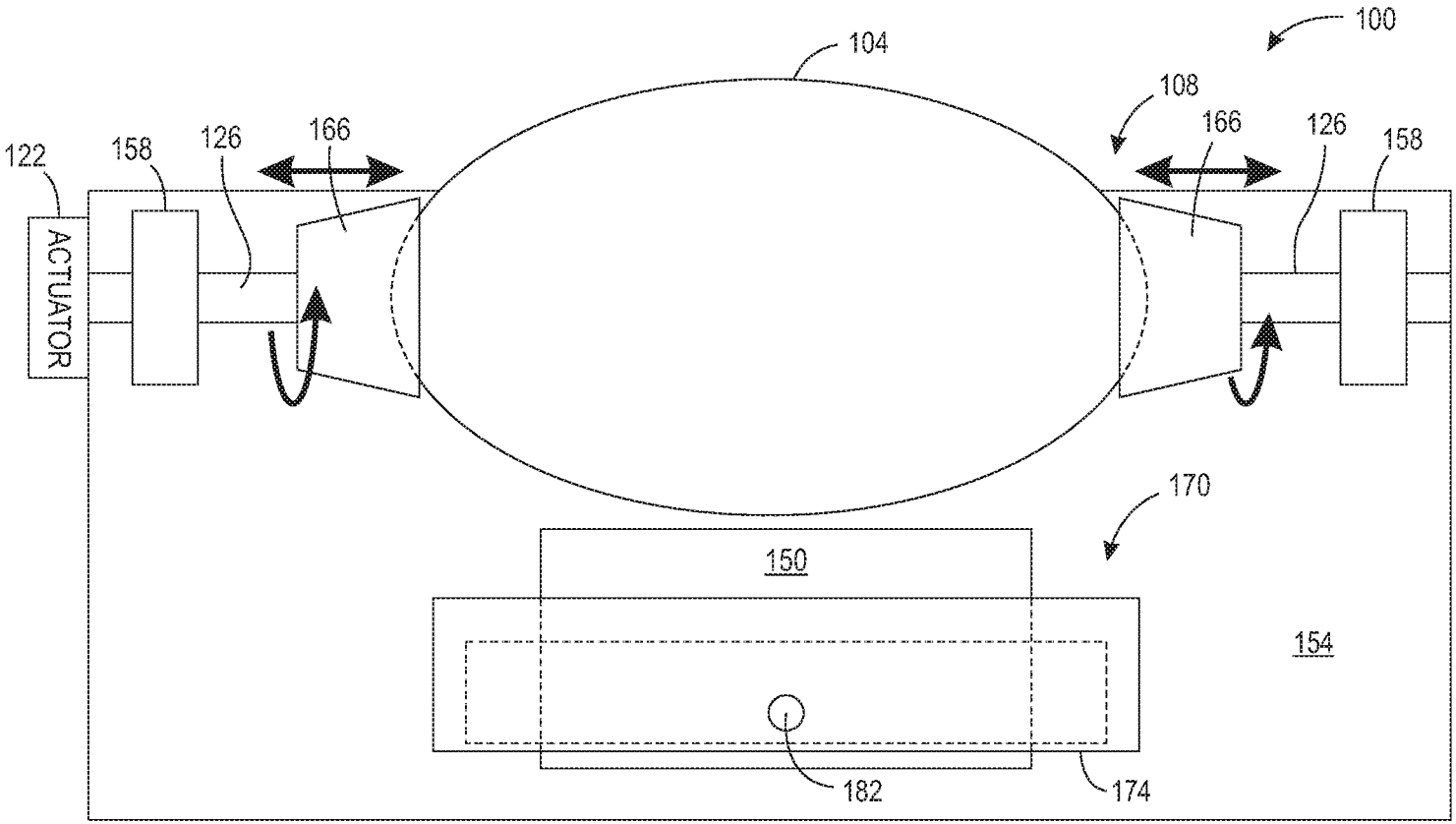
Figure 4C:
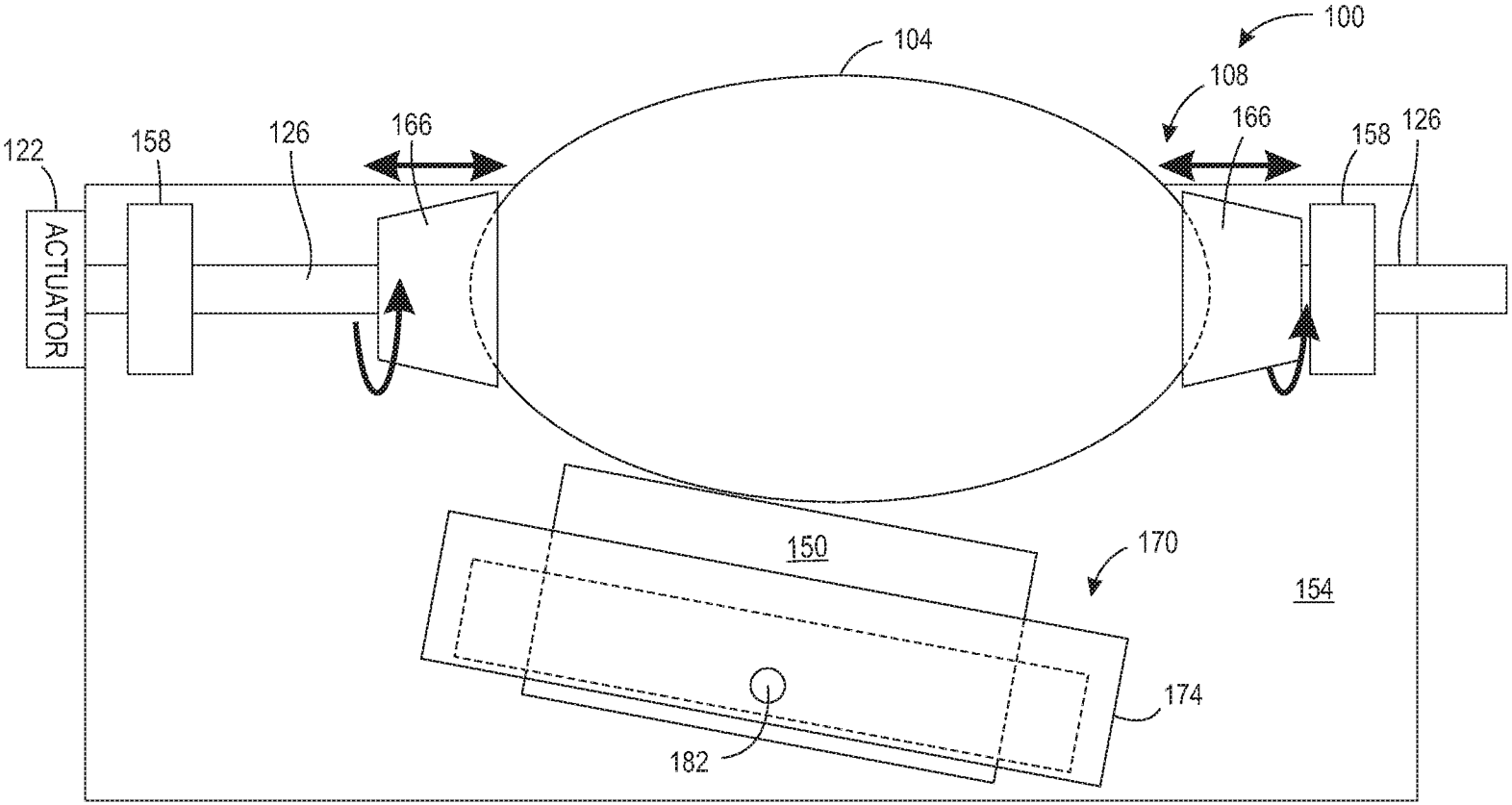

A process for printing an oblong object, such as a football, is shown in FIG. 4A to FIG. 4C. The object 104 is held by the grippers 166 on the shafts 126 as described above. The controller 124 operates the actuator 122 to translate one end of the object 104 opposite the printheads 118 and the controller operates the actuator 186 to pivot the frame 170 and the printheads 118 to the position shown in FIG. 3A. Once the object and printhead position is established, the printheads are operated with the controller. If the image is to cover a portion of the object larger than the portion immediately opposite the printheads 118, the controller can operate the actuator 122 to rotate the ball appropriately as the printheads are operated to continue printing the image around the perimeter of that portion of the ball. After the first end of the object is printed, the controller 124 operates the actuator 186 to pivot the frame 170 and the printheads 118 to the angle shown in FIG. 4B, which is the home position for the printhead array, and the controller 124 operates the actuator 122 to translate the object to the position shown in FIG. 4B. Once this second position is established, the printheads 118 are operated with the controller 124. Again, if the image is to cover a portion of the object larger than the portion immediately opposite the printheads 118, the controller can operate the actuator 122 to rotate the ball appropriately to continue the image around the perimeter of that portion of the ball. After this portion of the object is printed, the controller 124 operates the actuator 186 to pivot the frame 170 and the printheads 118 to the angle shown in FIG. 4C and the controller 124 operates the actuator 122 to translate the object to present the other end of the ball to the printheads 118 at the position shown in FIG. 4C. Once this position is established, the printheads 118 are operated with the controller 124. If the image is to cover a portion of the object larger than the portion immediately opposite the printheads 118, the controller can operate the actuator 122 to rotate the ball appropriately as the printheads are operated to continue printing the image around the perimeter of that portion of the ball. After this end of the object is printed, the controller 124 operates the actuator 186 to pivot the frame 170 and the printheads 118 to the angle shown in FIG. 4C to return the printhead array to its home position. The grippers 166 can now be released to enable removal of the object 104 from the system 100.

Figure 5:
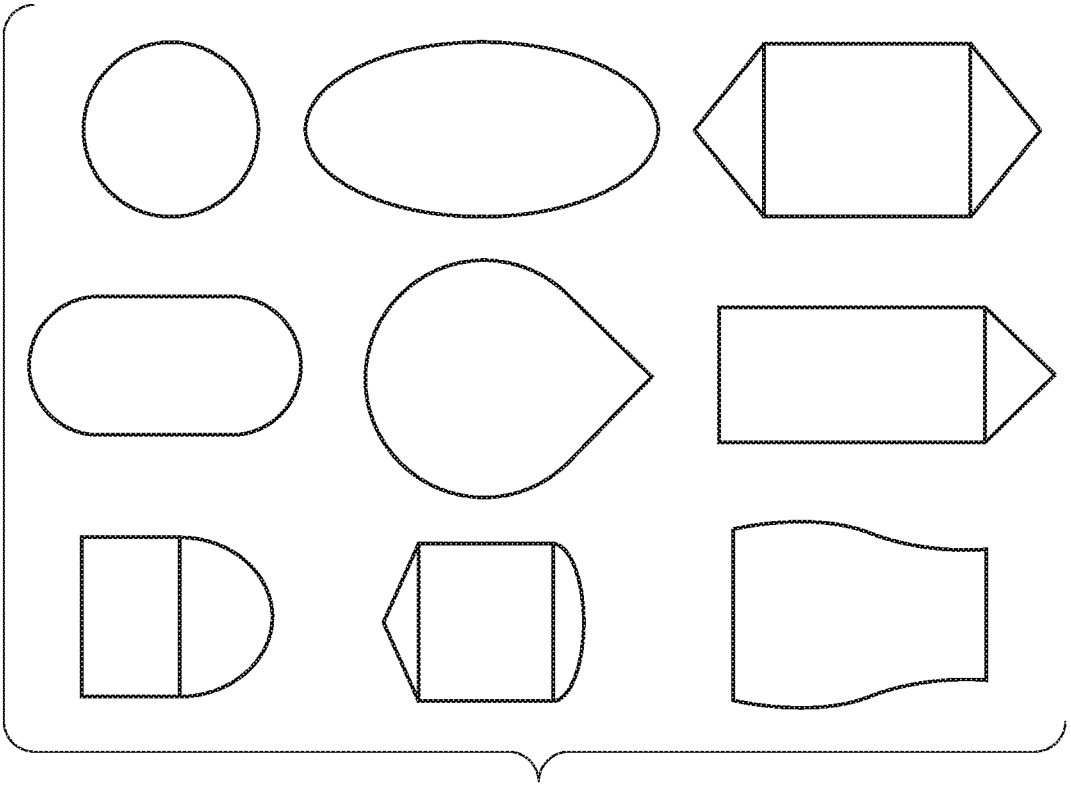
FIG. 5 depicts a variety of shapes that can be printed by the printer having a printhead pivoting subsystem.

FIG. 5 illustrates examples of other ovoid shapes that can be printed by operating the printing system 100 in a similar manner as noted above with regard to FIG. 4A to FIG. 4C. Data identifying these shapes can be entered into the user interface 122 (FIG. 1) and the controller 124 can use these data, such as codes identifying the shapes and dimensions of objects mounted in object holding subsystem 108, to determine how to move and position the printheads vertically, move and position the object horizontally, rotate the object, move the printheads toward or away from the object, and how to pivot the frame 170 and the printheads 118 for printing the object at various printhead array positions. Alternatively or additionally, the user interface includes an indicia reader, such as a bar code reader, that can obtain data that identify object shapes and positions from indicia on the object or on a tag or label attached to the object or otherwise associated with the object.

Figure 6:
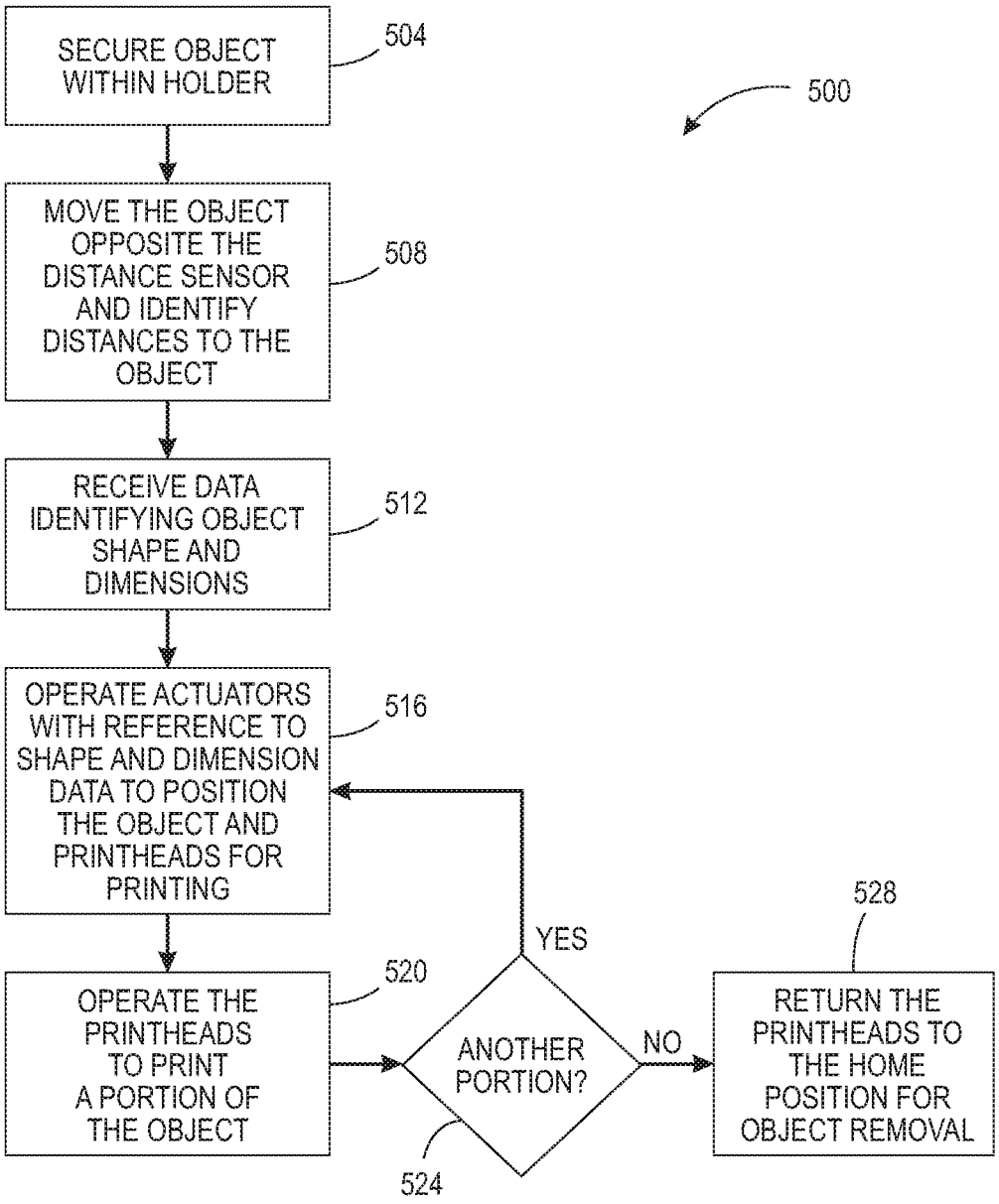
FIG. 6 depicts a process for operating the printing system of FIG. 1.

A process for operating the printer 100 is shown in FIG. 6. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 124 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the processing is described.

FIG. 6 is a flow diagram of a process 500 that operates the printing system 100 to pivot the frame 170 and the printheads 118 for printing an object 104 held within object holding subsystem 108. The process 500 begins with the object holding subsystem 108 being operated to secure the object 104 (block 504). The controller 124 operates the sensor 190 as it operates actuators 146 to enable the controller to identify distances between the faces of the printheads 118 and portions of the object when the object is opposite the printhead array in the home position (block 508). The controller 124 also receives data from the user interface that identifies the shape and dimensions of the object to be printed (block 512). The controller 124 operates the actuators 122, 146, 186, and 194 with reference to the shape and dimension data and to the identified distances to move the object and the printheads 118 to accommodate contours and features of the object (block 516). The controller 124 then operates the printheads with reference to ink image data to print the portion of the object facing the printheads (block 520). This printing of the object can include rotating of the object to print along a perimeter of the portion of the object facing the printheads and also includes moving the object opposite the UV curing device 150 and operating the device 150 to cure UV ink, if any printhead ejected UV curable marking material to form the image on the object. If another portion of the object is to be printed (block 524), then the controller 124 operates the actuators 122, 146, 186, and 194 to reposition the object 104 and the printheads 118 for printing the next object portion (block 516). The process then operates the printheads to print another portion of the object (block 520). This portion of the process continues until the printing of the object is complete (block 524). When printing is complete, the controller 124 operates the actuators 146, 186, and 194 to return the printheads 118 to their home position (block 528) so the object can be released from the object holding subsystem 108.

It will be appreciated that variations of the above-disclosed apparatus and other features, and functions, or alternatives thereof, may be desirably combined into many other different systems or applications. For example, while the embodiments described above have been illustrated with a vertical configuration, the printhead pivoting subsystem and the object holding subsystem can be configured in other orientations for pivoting and moving the object and printheads in the printer. Various presently unforeseen or unanticipated alternatives, modifications, variations, or improvements therein may be subsequently made by those skilled in the art, which are also intended to be encompassed by the following claims.

What is claimed is:

1. A printing system comprising:

a frame having:

a pair of cross-members, each cross-member being parallel to a longitudinal axis of the at least one printhead;

a pair of parallel members that are perpendicular to the pair of cross-members to form the frame as a rectangle;

a rotating member operatively connected to at least one of the cross-members; and a first actuator operatively connected to the rotating member;

at least one printhead, the at least one printhead being mounted to the frame and being configured to eject marking material;

a second actuator operatively connected to the frame, the second actuator being configured to rotate the frame about a pivot;

a holder configured to hold an object opposite the frame and the at least one printhead; and a controller operatively connected to the first actuator, the second actuator, and the at least one printhead, the controller being configured to operate the first actuator to rotate the rotating member to move the frame and the at least one printhead in a plane that is parallel to the rectangular frame bidirectionally, to operate the second actuator to pivot the frame and the at least one printhead about the pivot, and to operate the at least one printhead to eject marking material onto the object held by the holder.

2. The printing system of claim 1 wherein the rotating member is a lead screw that extends through a threaded hole in the at least one of the cross-members.

3. The printing system of claim 2, the frame further comprising:

a pair of channels for each printhead in the at least one printhead, each printhead in the at least one printhead being configured to slide bidirectionally in the pair of channels corresponding to the printhead;

a third actuator operatively connected to the at least one printhead; and the controller being operatively connected to the third actuator, the controller being further configured to operate the third actuator to move each printhead in the at least one printhead within the channels corresponding to the printhead bidirectionally.

4. The printing system of claim 3, the at least one printhead further comprising:

a plurality of printheads, each printhead being positioned within the one pair of channels corresponding to the printhead; and the controller being further configured to operate the third actuator to move each printhead independently of the other printheads in the plurality of printheads.

5. The printing system of claim 4 further comprising:

a sensor configured to generate data indicative of a distance between the sensor and a portion of the object in the holder opposite the sensor; and the controller being operatively connected to the sensor to receive the data generated by the sensor, the controller being configured to identify a distance between each printhead in the plurality of printheads and a portion of the object opposite each printhead with reference to the data generated by the sensor and to operate the third actuator to move each printhead in the plurality of printheads with reference to the identified distance for each printhead.

6. The printing system of claim 5, the controller being further configured to operate the second actuator to pivot the frame and the plurality of printheads with reference to the identified distance for each printhead.

7. The printing system of claim 6, the holder further comprising:

a cross-member;

a pair of members perpendicular to the cross-member to form a U-shaped frame, each member having an opening;

a pair of shafts, each shaft having a first end and a second end, the second end of each shaft terminating in a gripper and the first end of each shaft extending through the opening in one of the members in a mutually exclusive manner, each gripper being configured to hold a portion of the object to secure the object within the holder;

a fourth actuator operatively connected to the first end of one of the shafts, the fourth actuator being configured to rotate the one shaft; and the controller being operatively connected to the fourth actuator, the controller being further configured to operate the fourth actuator to rotate the one shaft and the object held between the grippers.

8. The printing system of claim 7, the fourth actuator being further configured to move the one shaft toward and away from the other shaft; and the controller being further configured to operate the fourth actuator to move the shafts and the object bidirectionally along an axis aligned with the two shafts.

9. The printing system of claim 8 further comprising:

a user interface operatively connected to the controller, the user interface being configured to receive data identifying a shape and dimensions for the object between the grippers; and the controller being further configured to operate the first actuator, the second actuator, the third actuator, and the fourth actuator with reference to the data identifying the shape and dimensions of the object in the holder received from the user interface.

10. The printing system of claim 9, the user interface further comprising:

a reader of indicia associated with the object, the indicia corresponding to the data identifying the shape and dimensions of the object in the holder.

11. A method of operating a printing system comprising:

operating with a controller a first actuator operatively connected to a frame in which at least one printhead is mounted to pivot the frame and the at least one printhead about a pivot;

operating with the controller a second actuator operatively connected to a rotating member that is operatively connected to a cross-member of the frame to rotate the rotating member and move the frame and the at least one printhead in a plane that is parallel to the frame bidirectionally; and operating the at least one printhead to eject marking material onto an object held by a holder at a position opposite the frame and the at least one printhead.

12. The method of claim 11 wherein the operation of the second actuator rotates a lead screw that extends through a threaded hole in the cross-member.

13. The method of claim 12, the frame further comprising:

operating with the controller a third actuator operatively connected to the at least one printhead to move each printhead in the at least one printhead bidirectionally within a pair of channels in the frame, each pair of channels corresponding to only one printhead in the at least one printhead.

14. The method of claim 13 further comprising:

operating with the controller the third actuator to move each printhead in a plurality of printheads mounted within the frame independently of the other printheads in the plurality of printheads.

15. The method of claim 14 further comprising:

generating with a sensor data indicative of a distance between the sensor and the portion of the object in the holder opposite the sensor;

identifying with the controller a distance between each printhead in the plurality of printheads and a portion of the object opposite each printhead with reference to the data generated by the sensor; and operating the third actuator to move each printhead in the plurality of printheads with reference to the identified distance for each printhead.

16. The method of claim 15 further comprising:

operating the first actuator with the controller to pivot the frame and the plurality of printheads with reference to the identified distance for each printhead.

17. The method of claim 16 further comprising:

operate with the controller a fourth actuator operatively connected to a first shaft positioned within an opening in a first leg of a U-shaped frame that is opposite a second shaft positioned within an opening in a second leg of the U-shaped member to rotate the first shaft and the object held between the gripper mounted to one end of the first shaft and the gripper mounted to one end of the second shaft.

18. The method of claim 17 further comprising:

operating the fourth actuator with the controller to move the first shaft, the second shaft, and the object bidirectionally along an axis aligned with the first shaft and the second shaft.

19. The method of claim 18 further comprising:

operating the first actuator, the second actuator, the third actuator, and the fourth actuator with the controller with reference to data received from a user interface that identifies a shape and dimensions of the object between the grippers.

* * * * *